US010618321B2

(12) United States Patent
Hiruma

(10) Patent No.: US 10,618,321 B2
(45) Date of Patent: Apr. 14, 2020

(54) PRINTING APPARATUS AND TARGET PRINTING MEDIUM HOLDING DEVICE

(71) Applicant: SEIKO EPSON CORPORATION, Tokyo (JP)

(72) Inventor: Daisuke Hiruma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/282,839

(22) Filed: Feb. 22, 2019

(65) Prior Publication Data

US 2019/0263149 A1 Aug. 29, 2019

(30) Foreign Application Priority Data

Feb. 23, 2018 (JP) ..... 2018-030481

(51) Int. Cl.

| | |
|---|---|
| ***B41J 11/00*** | (2006.01) |
| ***B41J 11/06*** | (2006.01) |
| ***B65H 5/22*** | (2006.01) |
| ***B41J 11/02*** | (2006.01) |
| ***B41J 13/22*** | (2006.01) |

(52) U.S. Cl.

CPC ..... *B41J 11/0085* (2013.01); *B41J 11/02* (2013.01); *B41J 11/06* (2013.01); *B41J 13/226* (2013.01); *B65H 5/222* (2013.01); *B65H 2406/332* (2013.01); *B65H 2406/351* (2013.01); *B65H 2406/3632* (2013.01)

(58) Field of Classification Search

CPC ..... B41J 11/02; B41J 11/06; B41J 11/0085; B41J 13/226; B65H 5/222; B65H 2406/332; B65H 2406/351; B65H 2406/3632

See application file for complete search history.

(56) References Cited

U.S. PATENT DOCUMENTS

| | | | | |
|---|---|---|---|---|
| 4,992,805 A * | 2/1991 | Yoshizawa | ..... | B41J 2/16511 346/104 |
| 6,254,090 B1 | 7/2001 | Rhodes et al. | | |
| 6,927,841 B2 * | 8/2005 | Hinojosa | ..... | B41J 11/0025 269/21 |

(Continued)

FOREIGN PATENT DOCUMENTS

| | | |
|---|---|---|
| JP | 2000-318870 A | 11/2000 |
| JP | 3694213 B | 7/2005 |

(Continued)

*Primary Examiner* — Anh T Vo

(74) *Attorney, Agent, or Firm* — Workman Nydegger

(57) ABSTRACT

A printer includes a platen including a loading surface on which a target printing medium is loaded and in which through holes are formed, a printing unit performing printing on the target printing medium, a platen stand on which the platen is loaded, the platen stand including air chambers communicating with the through holes, communication tubes that individually communicate with the air chambers, an air blower configured to suck and exhaust air in the air chambers, and suction opening/closing valves individually provided in the communication tubes, the suction opening/closing valves configured to open and close communication between the air blower and the plurality of air chambers. The plurality of air chambers are provided at different positions adjacent to one another in a length direction and a width direction of the target printing medium loaded on the loading surface.

8 Claims, 10 Drawing Sheets

(56) References Cited

U.S. PATENT DOCUMENTS

| | | | | |
|---|---|---|---|---|
| 7,354,147 | B2 * | 4/2008 | Beehler | B41J 11/0085 347/101 |
| 8,419,180 | B2 * | 4/2013 | Ishii | B41J 11/0065 347/104 |
| 2007/0267274 | A1 | 11/2007 | Steffan et al. | |
| 2011/0057380 | A1 | 3/2011 | Maeyama et al. | |

FOREIGN PATENT DOCUMENTS

| | | | |
|---|---|---|---|
| JP | 2007-308308 | A | 11/2007 |
| JP | 2011-056694 | A | 3/2011 |

* cited by examiner

PRINTING APPARATUS AND TARGET PRINTING MEDIUM HOLDING DEVICE

The entire disclosure of Japanese Patent Application No: 2018-030481, filed Feb. 23, 2018 is expressly incorporated by reference herein in its entirety.

BACKGROUND

1. Technical Field

The invention relates to a printing apparatus including a platen on which a target printing medium is loaded, and a target printing medium holding device.

2. Related Art

For example, known printing apparatuses (such as ink jet-type printers) include a platen with a loading surface on which a target printing medium is loaded and in which a plurality of suction holes are formed. The platen is configured to suck the target printing medium via the suction holes, to hold the target printing medium on the loading surface.

For example, JP-A-2000-318870 describes a sheet transporting apparatus including a transporting unit (e.g., a platen) with a plurality of air suction holes drilled in the transporting unit, and including a vacuum chamber installed on one side of the transporting unit. A sheet body (e.g., a target printing medium) is slidably transported while air is suctioned from the vacuum chamber to suck the sheet body via the air suction holes. The sheet transporting apparatus includes partition walls provided in the vacuum chamber to form a plurality of chambers along a transporting direction of the sheet body. This configuration changes a suction area of the transporting unit in association with a transporting position of the sheet body. Such a configuration allows the sheet body to be properly sucked onto the transporting unit.

Furthermore, JP-A-2011-56694 describes an image forming apparatus (for example, a printing apparatus) that includes a platen member in which a plurality of suction holes are formed, a plurality of air chambers faced by the suction holes formed in the platen member, and a suction means for sucking air in the air chambers through the suction holes. In the image forming apparatus, a plurality of air chambers are arranged in a direction intersecting the transporting direction of a target recording medium (e.g., a target printing medium). One suction means is connected to one of the plurality of air chambers, and at least one suction means is connected to other air chamber(s). Such a configuration allows a proper suction force to be exerted according to the size of the target recording medium.

However, in the sheet transporting apparatus described in JP-A-2000-318870, the vacuum chamber is internally provided with the partition walls forming the plurality of chambers each along the transporting direction of the sheet body (e.g., a target printing medium). Thus, if the plurality of holes for air suction were to be drilled in the transporting unit (e.g., a platen) in such a manner as to suck the entire sheet body, the number of air suction holes that are open to atmosphere may increase depending on the size of the sheet body in a width direction intersecting the transporting direction. This would particularly be the case if the sheet body has a narrow width. This may prevent sufficient suction force from being generated for application to the sheet body, disadvantageously precluding the sheet body from being properly sucked onto the transporting unit.

To account for this, the sheet transporting apparatus may be configured such that air is more strongly sucked from the vacuum chamber to exert a sufficient suction force even for a sheet body of narrow width. In such a case, if, for example, a sheet body has a large width and all (or many) of the air suction holes are blocked by the sheet body, the sheet body is strongly pulled into the air suction holes. The sheet body may then be caught in the air suction holes disadvantageously creating difficulty in moving the sheet body from the transporting unit.

In the image forming apparatus (printing apparatus) described in JP-A-2011-56694, a plurality of air chambers are each arranged in the direction intersecting the transporting direction of the target recording medium (which may be, for example, a target printing medium). Thus, in the case where the target recording medium has a short length, the number of suction holes that are open to the atmosphere increases depending on the size of the target recording (e.g., printing) medium in the transporting direction. This may disadvantageously preclude the proper suction force from being exerted onto the target recording medium. Furthermore, one suction means is connected to one of the plurality of air chambers and at least one suction means is connected to other air chamber(s). Thus, the provision of the plurality of suction means disadvantageously results in increased costs.

Additionally, the suction means may be configured to strongly pull the air in the air chambers to exert a sufficient suction force even on a target recording medium that has a short length in the transporting direction. In such a case, should the target recording medium have a long length in the transporting direction and all (or many) of the suction holes be blocked by the target recording medium, the target recording medium is strongly pulled into the suction holes. The target recording medium may then be caught in the suction holes and disadvantageously have difficulty being moved from the platen member.

SUMMARY

A printing apparatus includes a platen including a loading surface on which a target printing medium is loaded and in which a plurality of through holes are formed, a printing unit configured to perform printing on the target printing medium loaded on the loading surface, a platen stand on which the platen is loaded, the platen stand including a plurality of air chambers communicating with the plurality of through holes, a plurality of communication tubes configured to individually communicate with the plurality of air chambers, an air blower configured to suck and exhaust air in the plurality of air chambers with which the air blower communicates via the plurality of communication tubes, and a plurality of suction opening/closing valves individually provided in the plurality of communication tubes, the plurality of suction opening/closing valves capable of opening and closing communication between the air blower and the plurality of air chambers, wherein the plurality of air chambers are provided at different positions adjacent to one another in a length direction and a width direction of the target printing medium loaded on the loading surface.

Preferably, in the printing apparatus, the plurality of through holes are open in concave portions formed in the loading surface.

Preferably, in the printing apparatus, for each of the concave portions provided with the plurality of through holes communicating with the plurality of air chambers including the plurality of communication holes being open, as the concave portion is located at a farther distance from a communication hole through which a corresponding one of the plurality of communication tubes is open into a corresponding one of the plurality of air chambers, the through hole being open in the concave portion is formed at a position closer to the communication hole in the concave portion.

Preferably, in the printing apparatus, the concave portions are ring-shaped grooves.

Preferably, in the printing apparatus, a tube is provided in a flow path through which air flows between the communication hole through which a corresponding one of the plurality of communication tubes is open into a corresponding one of the plurality of air chambers and each of a plurality of the through holes communicating with the corresponding one of the plurality of air chambers in which the communication hole is open, and the tube provided in the flow path with a shorter distance between the communication hole and the through hole has a larger flow path length.

Preferably, in the printing apparatus, a honeycomb structural plate configured to back the platen is provided, wherein each of the tubes is formed of a prismatic tube included in the honeycomb structural plate.

Preferably, in the printing apparatus, a suction tube configured to cause a suction port of the air blower sucking air to communicate with atmosphere, an open opening/closing valve provided in the suction tube and configured to open and close communication between the atmosphere and the suction port, an air blow tube configured to communicate with the plurality of air chambers and to allow each of the plurality of air chambers to communicate with the exhaust port of the air blower through which air sucked by the air blower is exhausted, and an air blow opening/closing valve capable of opening and closing communication between the exhaust port and each of the plurality of air chambers via the air blow tube are provided.

A target printing medium holding device in the application includes a platen including a loading surface on which a target printing medium is loaded and in which a plurality of through holes are formed, a platen stand on which the platen is loaded, the platen stand including a plurality of air chambers communicating with the plurality of through holes, a plurality of communication tubes configured to individually communicate with the plurality of air chambers, an air blower configured to suck and exhaust air in the plurality of air chambers with which the air blower communicates via the plurality of communication tubes, and a plurality of suction opening/closing valves individually provided in the plurality of communication tubes, the plurality of suction opening/closing valves configured to open and close communication between the air blower and the plurality of air chambers, wherein the plurality of air chambers are provided at different positions adjacent to one another in a length direction and a width direction of the target printing medium loaded on the loading surface.

BRIEF DESCRIPTION OF THE DRAWINGS

The invention will be described with reference to the accompanying drawings, wherein like numbers reference like elements.

DESCRIPTION OF EXAMPLE EMBODIMENTS

Figure 1:
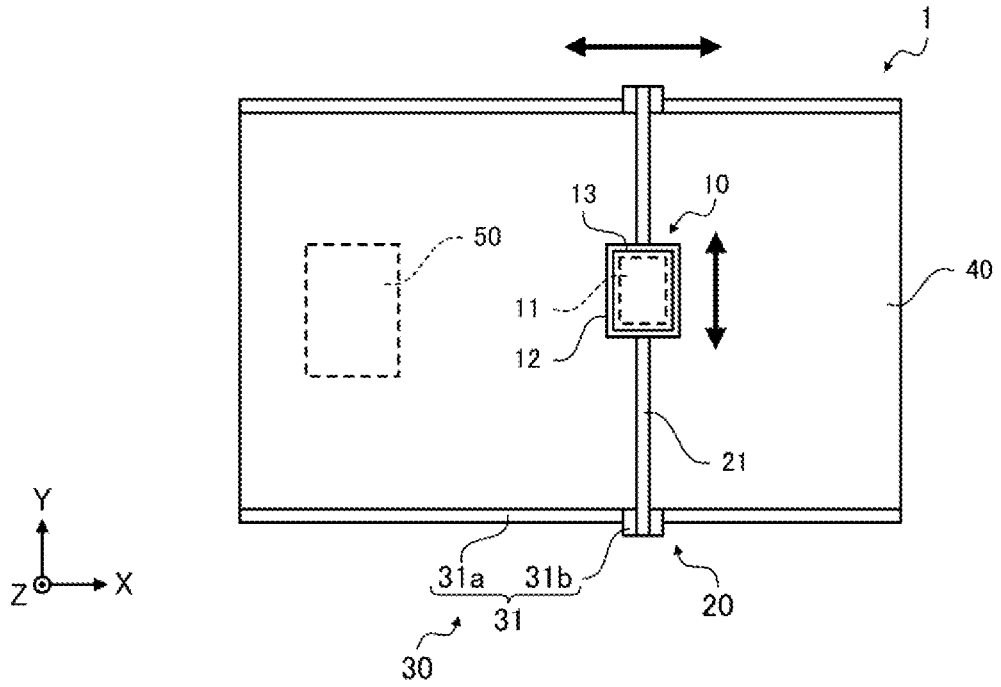
FIG. 1 is a conceptual drawing illustrating a configuration of a printing apparatus according to Example Example Embodiment 1.

Example embodiments applied with the invention will be described with reference to the drawings. The following is one example embodiment of the invention and is not intended to limit the invention. Note that, in each of the following drawings, a scale different from the actual scale may be described to make the description to be easily understood. In the coordinates illustrated in the drawings, a Z-axial direction is an up-and-down direction, a +Z direction is an upward direction, and an X-Y plane is a horizontal plane.

Example Embodiment 1

Basic Configuration of Printing Apparatus

Figure 2:
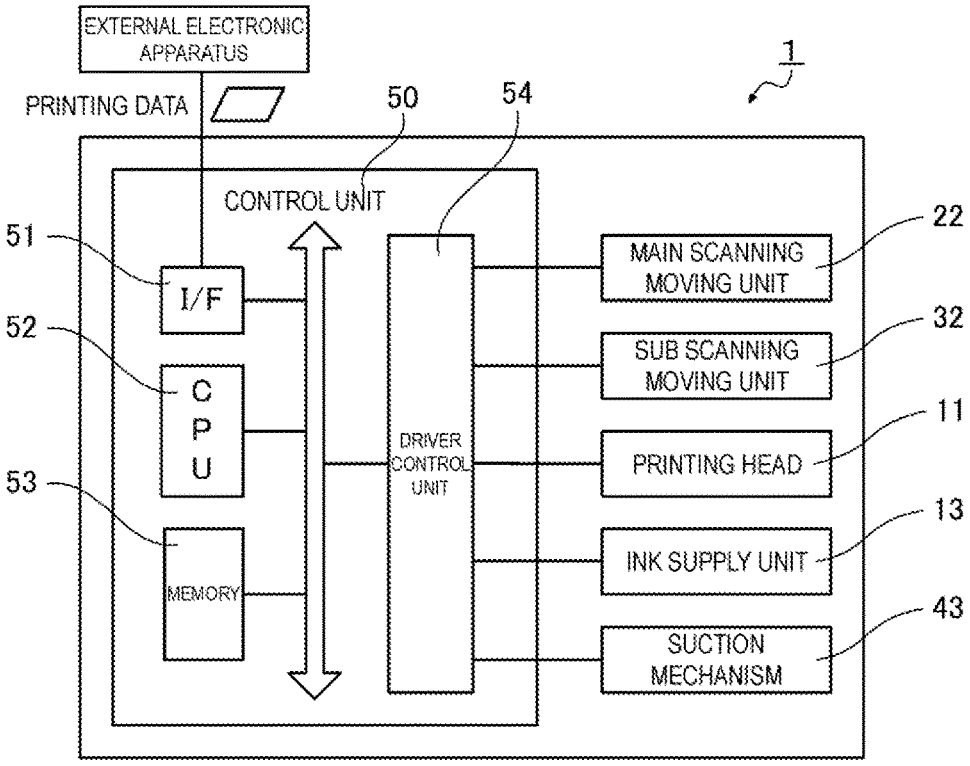
FIG. 2 is a block diagram illustrating the configuration of the printing apparatus according to Example Embodiment 1.

FIG. 1 is a conceptual drawing illustrating a configuration of a printer 1 as a "printing apparatus" according to Example Embodiment 1. FIG. 2 is a block diagram illustrating the configuration of the printer.

The printer 1 is an ink jet-type printer of a flat bed type and includes, for example, a printing unit 10, main scanning unit 20, a sub scanning unit 30, a support table 40, and a control unit 50. The printer 1 is configured to discharge a printing liquid (hereinafter referred to as "ink") from a printing unit 10 that moves relative to a target printing medium that is approximately horizontally supported by a support table 40, to thereby perform printing. Examples of the target printing medium include a plate-like body formed of a sheet body such as a paper or film, a wood or metal material, a resin material, or the like.

The printing unit 10 is a unit configured to discharge ink onto the target printing medium loaded on the support table 40, the ink being discharged as ink droplets under the control of a control unit 50. The printing unit 10 includes, for example, a printing head 11, a carriage 12, and an ink supply unit 13.

The printing head 11 includes a plurality of nozzles (not illustrated in the drawing) that discharge ink as ink droplets. The printing head 11 is mounted in the carriage 12 that moves relative to the target printing medium that is supported by the support table 40.

The ink supply unit 13 includes, for example, an ink cartridge holder (not illustrated in the drawing) that is equipped with ink cartridges that store inks, and that is equipped with ink supplying paths (not illustrated in the drawing) through which the inks are supplied to the printing head 11 from the ink cartridges. The ink supply unit 13 is mounted in the carriage 12.

For example, as an ink set configured with dark ink compositions, the ink set of four colors obtained by adding black (K) to ink set of three colors of cyan (C), magenta (M), and yellow (Y) is used. Furthermore, the ink set may be, for example, an ink set of eight colors obtained by adding an ink set of light cyan (Lc), light magenta (Lm), light yellow (Ly), light black (Lk) (and the like) which are configured with low density ink compositions in which the density of each color material is made low.

A piezo method is used as a method for discharging ink droplets (ink jet method). The piezo method is a printing method in which a pressure corresponding to a printing information signal is applied by a piezoelectric element (piezo element) to ink stored in a pressure chamber, and ink droplets are thereby ejected (discharged) from a nozzle communicating with the pressure chamber.

Note that the method for discharging ink droplets is not limited to this, and may be another printing method in which ink is ejected in a droplet shape to form a dot group on the target printing medium. For example, the method for discharging ink droplets may be a method in which the ink is continuously ejected in a droplet shape from a nozzle in the presence of a strong electric field that is between the nozzle and an acceleration electrode placed in front of the nozzle, and a printing information signal is supplied from a deflection electrode while the ink droplets flying. As other examples, the method for ejecting ink droplets may be a method (electrostatic attraction method) for ejecting ink droplets in response to the printing information signal without deflection, a method in which the ink droplet is forcibly ejected by applying pressure to the ink by a small pump and mechanically vibrating the nozzle with a quartz oscillator and the like, and a method (thermal jet method) in which the ink is heated to be foamed by a micro electrode according to the printing information signal and the ink droplet is ejected to perform printing, and the like.

The main scanning unit 20 includes a guide shaft 21 and a main scanning moving unit 22 to move the carriage 12 equipped with the printing head 11 and the ink supply unit 13, in a main scanning direction (Y-axial direction) relative to the target printing medium supported on the support table 40. The main scanning unit 20 is movable, by the sub scanning unit 30, in a sub scanning direction (X-axial direction) relative to the target printing medium supported on the support table 40.

The guide shaft 21 extends in the main scanning direction (Y-axial direction) to support the carriage 12 such that the guide shaft 12 can slidably contact the carriage 12.

The main scanning moving unit 22 includes a timing belt coupled to the carriage 12 and a carriage motor (not illustrated in the drawing) configured to rotate the timing belt. The carriage motor serves as a drive source for reciprocating the carriage 12 along the guide shaft 21.

The main scanning unit 22 is configured to move the carriage 12 (in other words, the printing head 11) in the main scanning direction (Y-axial direction) along the guide shaft 21, the movement being under the control of the control unit 50.

The sub scanning unit 30 includes a guide mechanism 31 and a sub scanning moving unit 32 to move the main scanning unit 20 in the sub scanning direction (X-axial direction) relative to the target printing medium supported on the support table 40.

The guide mechanism 31 includes an LM guide (trade name). The guide mechanism 31 includes, for each of both sides of the support table 40, a guide rail 31*a* extending in the sub scanning direction (X-axial direction) and fixed to the respective side of the support table 40, and a slider 31*b* configured to slide in the sub scanning direction (X-axial direction) relative to the respective guide rail 31*a*. Both ends of the guide shaft 21 of the main scanning unit 20 are fixedly supported by the slider 31*b*.

The sub scanning moving unit 32 is a unit configured to slide the slider 31*b* in the sub scanning direction (X-axial direction), and includes a screw shaft extending in the sub scanning direction (X-axial direction) and fixed to the support table 40, a nut member threadably engaged with the screw shaft, and a sub scanning motor (not illustrated in the drawing) that rotates the nut member. The sub scanning motor serves as a drive source for reciprocating the main scanning unit 20 (guide shaft 21) along the guide rail 31*a*.

The sub scanning moving unit 32 is configured to move the guide shaft 21 (in other words, the printing head 11) in the sub scanning direction (X-axial direction) along the guide rail 31*a* under the control of the control unit 50.

The support table 40 is a "target printing medium holding device" according to Example Embodiment 1, and includes a platen 41, a platen loading stand 42, and a suction mechanism 43. The support table 40 will be described below in detail.

As illustrated in FIG. 2, the control unit 50 includes an interface (I/F) 51, a CPU 52, a memory 53, and a drive control unit 54 to control the printer 1.

The interface 51 is connected to an external electronic apparatus (e.g., a personal computer) to transmit and receive data.

The CPU 52 is a calculation processing device configured to control the printer 1 as a whole.

The memory 53 is a storage medium that secures an area for storing programs operated by the CPU 52, a working area for operation, and the like, and is configured with a storage element such as a RAM and an EEPROM.

The CPU 52 is configured to control the printing unit 10 (printing head 11 and ink supply unit 13), the main scanning unit 20 (main scanning moving unit 22), the sub scanning unit 30 (sub scanning moving unit 32), and the support table 40 (suction mechanism 43) via the drive control unit 54 in accordance with the program stored in the memory 53 and the printing data received from the external electronic apparatus.

The processing data is image data on which a printing image is based and to which image processing such as halftone processing (a process of converting an unconverted tone value of the image data into a converted tone value that is a tone value corresponding to dots formed on the target printing medium by the printing apparatus (so-called binarization processing)) is applied.

In the above-described configuration, the control unit 50 causes the printing head 11 to discharge ink droplets while moving the carriage 12 supporting the printing head 11, in the main scanning direction (Y-axial direction) and the sub scanning direction (X-axial direction) relative to the target printing medium supported on the support table 40, thus forming (printing), on the target printing medium, a desired image based on image data (printing data).

Configuration of Target Printing Medium Holding Device

Figure 3:
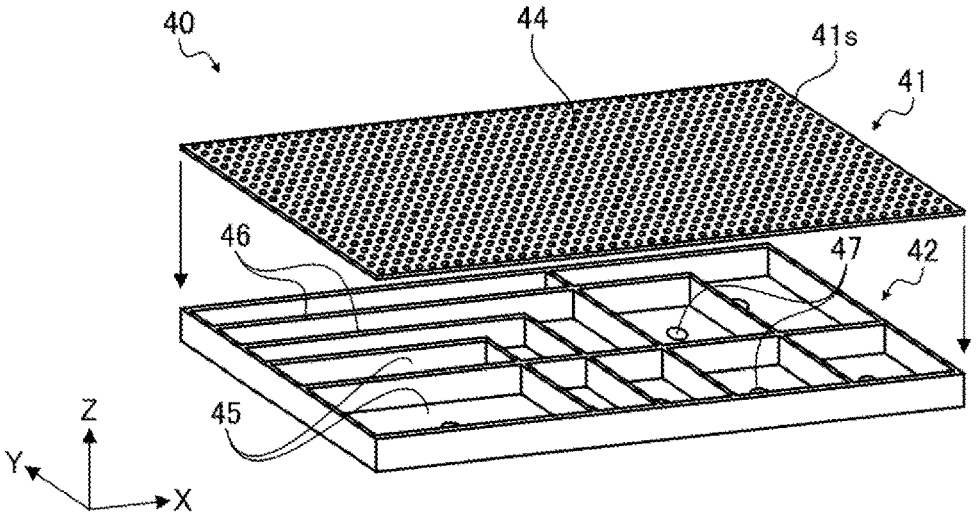
FIG. 3 is a perspective view illustrating a configuration of a target printing medium holding device according to Example Embodiment 1.

FIG. 3 is a perspective view illustrating a configuration of the support table 40 serving as the "target printing medium holding device" according to Example Embodiment 1.

Figure 5:
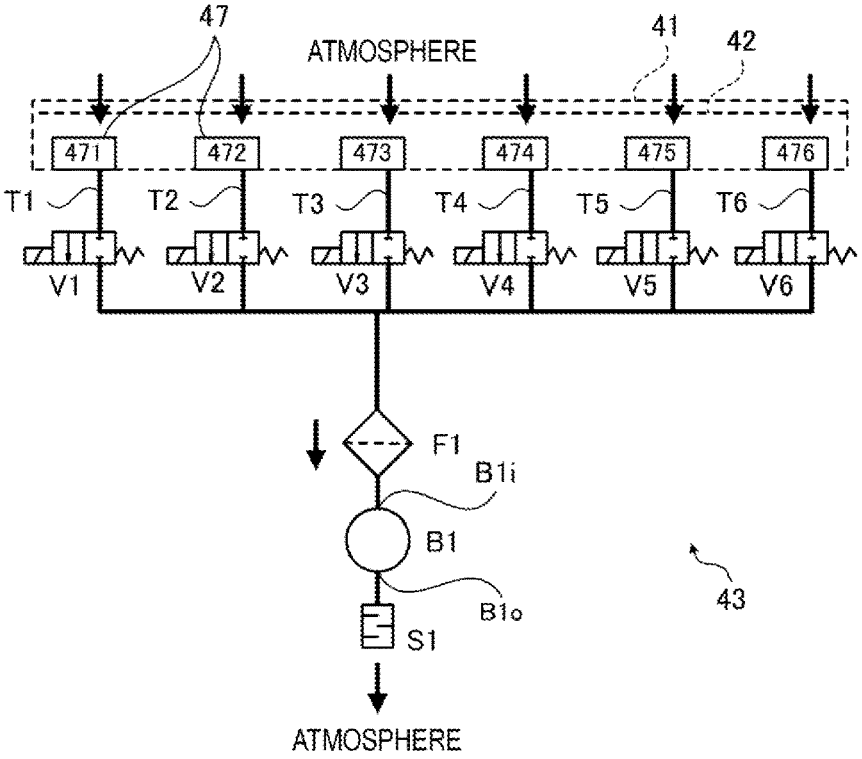
FIG. 5 is a pneumatic circuit diagram illustrating a configuration of a suction mechanism provided in the target printing medium holding device.

The support table 40 includes the platen 41, the platen loading stand 42, and the suction mechanism 43 (see FIG. 5). In FIG. 3, illustration of the suction mechanism 43 is omitted.

The platen 41 is a plate-like body including a loading surface 41S on which the target printing medium is loaded. The platen 41 includes a plurality of through holes 44 penetrating the loading surface 41S and opened in the loading surface and a back side of the loading surface. The through holes 44 are suction holes configured to suck the target printing medium onto the loading surface 41S. The through holes 44 are arranged in a matrix at approximately regular intervals. Note that a diameter of each of the through holes 44 open in the loading surface 41S is preferably preliminarily evaluated in accordance with specifications of the target printing medium and set to a value within an allowable range, so as to prevent the target printing medium from being deformed by a suction force or so as to prevent a deformation amount from exceeding an allowable range.

The platen loading stand 42 is a unit on which the platen 41 is loaded and fixed. The platen loading stand 42 includes a plurality of air chambers 45 formed on an underside of the platen 41 (opposite to the loading surface 41S) in communication with the through holes 44. Specifically, the platen loading stand 42 is a box body that is open at a top portion of the platen loading stand 42. The platen 41 loaded on the platen loading stand 42 forms the top portion (ceiling). The platen loading stand 42 includes a plurality of partition plates 46 dividing the inside of the box body into a plurality of spaces (air chambers 45). Furthermore, the platen loading stand 42 includes a plurality of communication holes 47 at a bottom portion of the box body. One communication hole 47 is formed in each of the air chambers 45 into which the inside of the box body is divided by the partition plates 46.

In other words, each of the air chambers 45 provided inside the platen loading stand 42 (on the underside of the platen 41) is configured as a space that is open at the top portion due to the plurality of through holes 44, and at the bottom portion due to the one communication hole 47.

Figure 4:
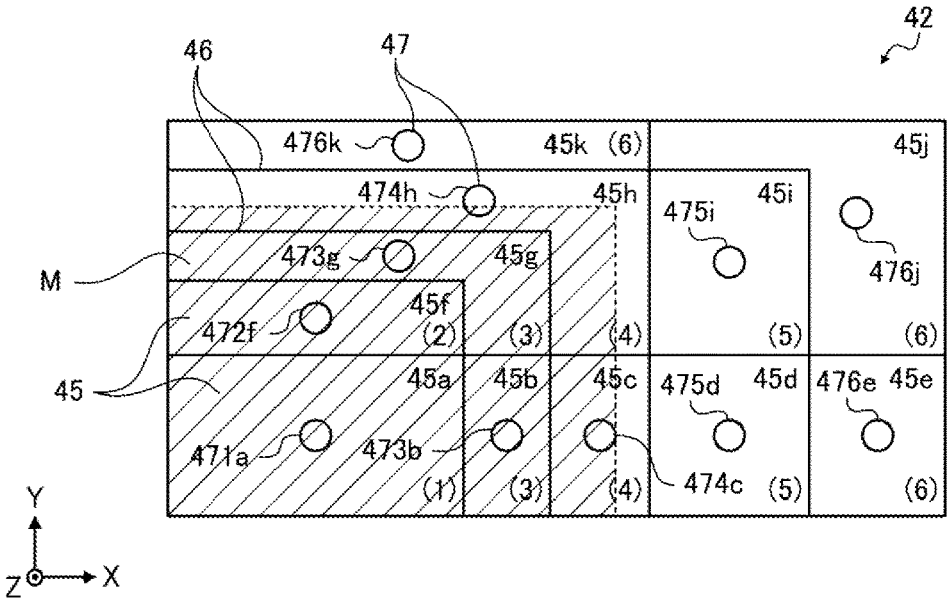
FIG. 4 is a plan view illustrating an arrangement of partition plates forming a plurality of air chambers and of communication holes.

FIG. 4 is a plan view illustrating an arrangement of the partition plates 46 forming the plurality of air chambers 45 and of the communication holes 47 each formed in the corresponding air chamber 45.

As illustrated in FIG. 3 and FIG. 4, the air chambers 45 provided on the underside of the platen 41 include 11 air chambers 45*a* to 45*k* into which the platen loading stand 42 is divided by the partition plates 46. Specifically, five air chambers 45*a* to 45*e* are arranged in this order in a length direction (X-axial direction) of the target printing medium, and five air chambers 45*f* to 45*j* are each provided on a +Y side of the air chambers 45*a* to 45*e* in a width direction (Y-axial direction) of the target printing medium. Furthermore, the air chambers 45*g*, 45*h*, and 45*j* are each configured to have a bent shape due to a bent partition plate 46. The air chamber 45*g* is positioned to occupy a +Y side of the air chamber 45*b* and the air chamber 45*f*. The air chambers 45*h* is positioned to occupy a +Y side of the air chamber 45*c* and the air chamber 45*g*. The air chambers 45*j* is positioned to occupy a +Y side of the air chamber 45*e* and the air chamber 45*i*. Additionally, the air chamber 45*k* is positioned to occupy a +Y side of the air chamber 45*h*.

That is, the plurality of air chambers 45 are provided at different positions adjacent to one another in the length direction (X-axial direction) and the width direction (Y-axial direction) of the target printing medium loaded on the loading surface 41S.

Such arrangement of the partition plates 46 (in other words, the arrangement of the air chambers 45*a* to 45*k*) is determined according to a type (size) of the target printing medium to be printed by the printer 1 (in other words, the type of the target printing medium to be loaded on the support table 40). A method for determining the arrangement positions of the partition plates 46 will be described below.

In each of the air chambers 45 into which the platen loading stand 42 is divided by the partition plates 46, one communication hole 47 is formed in a generally central area of the air chamber 45 when the air chambers 45 are individually viewed in plan. Preferably, as an example, the specific position of each communication hole 47 is a center-of-gravity position of the shape of the corresponding air chamber 45 or is close to the center-of-gravity position when the air chamber 45 is viewed in plan.

Note that the expression "when the air chamber 45 is viewed in plan" means when looking down on the air chamber 45 from a +Z direction toward a −Z direction.

FIG. 5 is a pneumatic circuit diagram illustrating a configuration of the suction mechanism 43.

The suction mechanism 43 includes, for example, communication tubes T1 to T6, an air blower B1, a suction opening/closing valves V1 to V6, a filter F1, and a silencer S1.

The communication tubes T1 to T6 are piping including first ends individually communicating with the respective communication holes 47 (communication holes 471 to 476) in the 11 air chambers 45*a* to 45*k*, and second ends collectively communicating with a suction port B1*i* of the air blower B1 via the filter F1.

The air blower B1 is an air blow device configured to suck and exhaust air in the air chambers 45*a* to 45*k* with which the air blower B1 communicates via the communication tubes T1 to T6, respectively.

The suction opening/closing valves V1 to V6 are two-port solenoid valves individually provided in the communication tubes T1 to T6 and which are capable of opening and closing communication between the air blower B1 and the air chambers 45*a* to 45*k*, respectively.

The filter F1 is an air filter configured to trap foreign materials (e.g., ink mist) contained in air sucked from the air chambers 45*a* to 45*k*.

The silencer S1 is configured to reduce exhaust sound of air exhausted through an exhaust port B1*o* of the air blower B1.

An exhaust system from the air chambers 45 to the silencer S1 is divided into six systems by the communication tubes T1 to T6. Specifically, the 11 air chambers 45*a* to 45*k* are divided into six groups corresponding to the respective six systems, and air can be independently sucked from each of the groups by controlling the opening and closing of the suction opening/closing valves V1 to V6.

The six groups of the air chambers 45*a* to 45*k* are denoted by parenthesized numbers (1) to (6) in FIG. 4.

That is, the group (1) includes the air chambers 45*a*, the group (2) includes the air chambers 45*f*, the group (3) includes the air chamber 45*b* and the air chamber 45*g*, the group (4) includes the air chamber 45*c* and the air chamber 45*h*, the group (5) includes the air chamber 45*d* and the air chamber 45*i*, and the group (6) includes the air chamber 45*e*, the air chamber 45*j*, and the air chamber 45*k*.

The communication holes 47 (communication holes 471 to 476) for the six systems illustrated in FIG. 5 correspond to the 11 communication holes 471*a* to 476*k* illustrated in FIG. 4.

Specifically, the communication hole 471 means the communication hole 471*a*, the communication hole 472 means the communication hole 472*f*, the communication hole 473 means the communication hole 473*b* and the communication hole 473*g*, the communication hole 474 means the communication hole 474*c* and the communication hole 474*h*, the communication hole 475 means the communication hole 475*d* and the communication hole 475*i*, and the communication hole 476 means the communication hole 476*e*, the communication hole 476*j*, and the communication hole 476*k*.

Note that the communication tubes T3 to T6 communicating with the air chambers 45 in the groups (3) to (6) correspond to a plurality of the communication holes 47 (e.g., the communication tube T3 communicates with both the communication hole 473*b* and the communication hole 473*g*) but that illustration of these branches are omitted in FIG. 5.

In the above-described configuration of the pneumatic circuit of the suction mechanism 43, the air blower B1 controllably sucks air, while the control unit 50 performs opening/closing control on the suction opening/closing valves V1 to V6. This allows air to be selectively sucked through the through holes 44 communicating with the corresponding air chambers 45*a* to 45*k* divided into the six groups.

Such a configuration is used to effectively and efficiently suck target printing media with various sizes onto the loading surface 41S based on selective suction of air through the through holes 44. To achieve this, the arrangement positions of the partition plates 46 forming the air chambers 45*a* to 45*k* are determined as follows.

First, in a design stage for the printer 1 (support table 40), the type (size) of the target printing medium to be printed by the printer 1 (in other words, the target printing medium to be loaded on the support table 40) is determined. Specifically, for example, a plurality of desired sizes are selected from standard sizes determined by industrial standards. Alternatively, the sizes of the particular target printing medium to be printed by the printer 1 are clarified.

Then, target printing media with the selected or clarified plurality of sizes are each loaded on the platen 41 at a prescribed position (where the target printing media are printed). At this time, the partition plates 46 are positioned such that, for the through holes 44 communicating with the air chambers 45 (one or two or more air chambers 45 of the 11 air chambers 45*a* to 45*k*) positioned to overlap the target printing medium in a plan view, the number of through holes 44 not positioned to overlap the target printing medium in a plan view is not greater than a prescribed number n.

Details will be described with reference to FIG. 4.

A hatched rectangle in FIG. 4 represents a target printing medium M selected as a printing target of the printer 1 and loaded on the platen 41 at the prescribed position.

The target printing medium M overlaps the six air chambers 45: air chambers 45*a*, 45*b*, 45*c*, 45*f*, 45*g*, and 45*h* in a plan view. In this case, suction of the target printing medium M may be achieved without a need to suck air through the communication tubes T5 and T6 communicating with the air chambers 45 (the air chambers 45*d*, 45*e*, 45*i*, 45*j*, and 45*k*, i.e., the air chambers 45 in the groups (5) and (6)) that are not positioned to overlap the target printing medium M. Thus, the suction opening/closing valves V5 and V6 are controlled to be closed. In other words, the target printing medium M is sucked via the through holes 44 corresponding to the six air chambers 45 (air chambers 45*a*, 45*b*, 45*c*, 45*f*, 45*g*, and 45*h*) overlapped by the target printing medium M.

Here, the air chamber 45*c* and the air chamber 45*h*, (which are included in the six air chambers 45 overlapped by the target printing medium M) each include an area not covered with the target printing medium M (the area outside the hatched area). The through holes 44 corresponding to this area are not covered with the target printing medium M. Thus, the air chamber 45*c* and the air chamber 45*h* are open to the atmosphere via these through holes 44. Design values for the positions of the partition plates 46 forming the +X side and the +Y side of each of the air chambers 45*c* and the air chambers 45*h* are set to correspond to positions such that the number of through holes 44 in the area not covered with the target printing medium M is not greater than the prescribed number n.

For target printing media with the other sizes to be printed by the printer 1, the positions of the partition plates 46 are determined in a similar way. The platen loading stand 42 is configured based on the design specifications determined as described above (the plurality of arrangement positions of the partition plates 46).

Note that the prescribed number n is a maximum allowable number of through holes 44 open to the atmosphere and is needed to allow the target printing medium M to be sucked and held on the platen 41 and that the prescribed number n is determined, through sufficient evaluation, to be a value at which a necessary and sufficient negative pressure is obtained in the air chambers 45 positioned to overlap the target printing medium M.

As described above, according to the printing apparatus and the target printing medium holding device according to Example Embodiment 1, the following advantages can be achieved.

The air blower B1 sucks the air in the air chambers 45 to pull the target printing medium loaded on the loading surface 41S via the through holes 44 formed in the loading surface 41S of the platen 41 in communication with the air chambers 45. This allows the target printing medium to be held (sucked) on the loading surface 41S of the platen 41.

Furthermore, the plurality of air chambers 45 (11 air chambers 45*a* to 45*k*) are provided that communicate with the through holes 44 formed in the loading surface 41S of the platen 41. Furthermore, the suction opening/closing valves V1 to V6 are provided that are capable of opening and closing the communication between each of the air chambers 45 and the air blower B1 that sucks and exhausts the air in the air chamber 45. Thus, the suction opening/closing valves V1 to V6 are opened or closed to allow selection of an area where the through holes 44 are arranged via which the target printing medium is sucked and held on the loading surface 41S of the platen 41. The through holes 44 positioned to be covered with the target printing medium (the area where the through hole 44 are arranged) are selected in accordance with the size of the target printing medium. This allows the target printing medium to be more effectively and efficiently held in place using suction.

Furthermore, the air chambers 45 are provided at different positions in the length direction and the width direction of the target printing medium. Thus, the suction opening/closing valves V1 to V6 are opened or closed to allow the through holes 44 via which the target printing medium is sucked and held (the area where the through holes 44 are arranged) to be selected in the length direction and the width direction of the target printing medium. That is, the air chambers 45 are arranged to allow selection of the through holes 44 positioned to be covered with the target printing medium, in accordance with target printing media with different sizes in the length direction and/or the width direction. This allows the target printing medium to be more effectively and efficiently sucked and held according to the size of the target printing medium.

As a result, the printing unit 10 is capable of more stably printing the target printing medium loaded on the loading surface 41S of the platen 41.

Furthermore, it may be sufficient to provide a single air blower B1 for the plurality of air chambers 45 provided to allow selection, according to the size of the target printing medium, of the through holes 44 positioned to be covered with the target printing medium. Compared to a case where the air blower B1 is independently provided for each of the plurality of air chambers 45, the configuration in Example Embodiment 1 enables prevention of an increase in costs.

Example Embodiment 2

Now, a printing apparatus and a target printing medium holding device according to Example Embodiment 2 will be described. Note that, the same constituents as those in the example embodiment described above are given the same reference signs, and redundant description of these constituents will be omitted.

In the description of Example Embodiment 1, the platen (platen 41) includes the plurality of through holes (through holes 44) penetrating the loading surface (loading surface 41S) and opened in the loading surface and the back side of the loading surface, the through holes being arranged in a matrix at approximately regular intervals. In Example Embodiment 2, the through holes (through holes 44*a*) formed in the platen (platen 41*a*) are open in concave portions formed in the loading surface (loading surface 41Sa).

Details will be described below.

Figure 6:
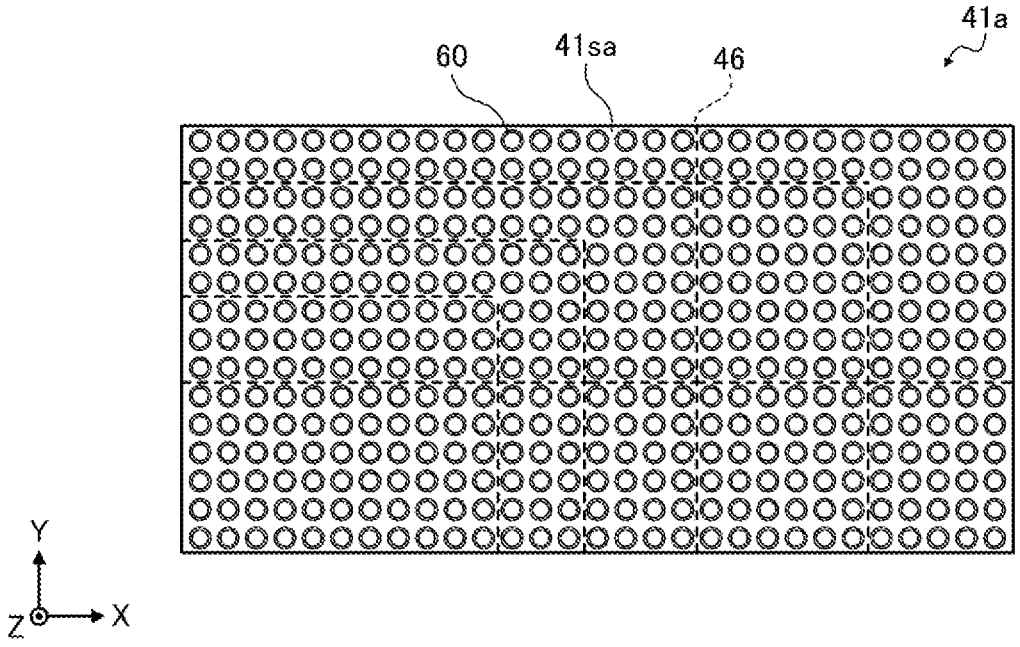
FIG. 6 is a plan view of a platen provided in a printing apparatus and in a target printing medium holding device according to Example Embodiment 2.

FIG. 6 is a plan view of the platen 41*a* provided, instead of the platen 41, in the printing apparatus (printer 1) and in the target printing medium holding device (support table 40) according to Example Embodiment 2.

As illustrated in FIG. 6, the platen 41*a* includes ring-shaped grooves 60 (hereinafter referred to as ring grooves 60) serving as "concave portions" arranged in the loading surface 41Sa in a matrix at approximately regular intervals. The through holes 44*a* according to Example Embodiment 1 replacing the through holes 44 are formed to be open in the portions of the respective ring grooves 60. Note that, in FIG. 6, dashed lines represent the positions of the partition plates 46.

Figure 7:
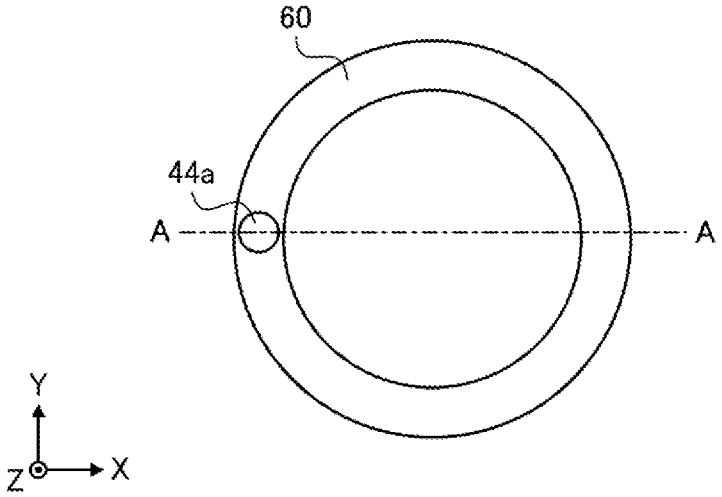
FIG. 7 is a plan view illustrating a ring-shaped groove serving as a concave portion and a through hole open in the ring-shaped groove.

FIG. 7 is a plan view illustrating an example of the ring groove 60 and the through hole 44*a* open in the ring groove 60. Furthermore, FIG. 8 is a cross-sectional view taken along line A-A in FIG. 7.

Figure 8:
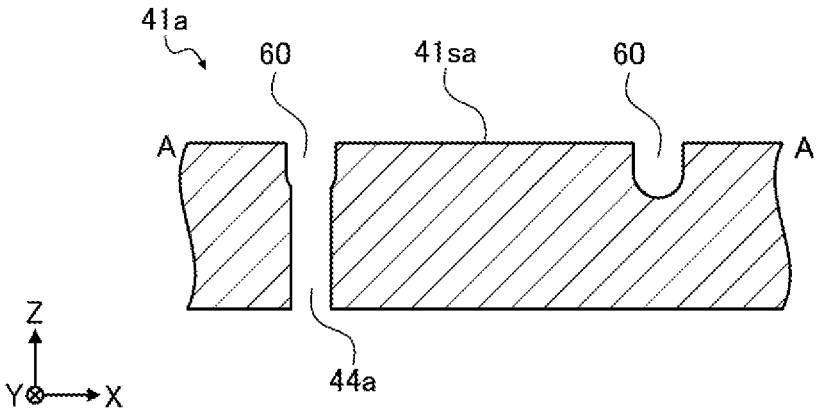
FIG. 8 is a cross-sectional view illustrating the ring-shaped groove serving as the concave portion and the through hole open in the ring-shaped groove.

As illustrated in FIG. 7 and FIG. 8, the through holes 44*a* are formed to extend in a Z-axial direction and open in a bottom portion of the ring groove 60. In other words, the through hole 44*a* extending in the Z-axial direction includes an opening into the loading surface 41Sa formed as a shape of the ring groove 60.

Except for the above-described components, the printer 1 and the support table 40 according to Example Embodiment 2 are the same as the printer 1 and the support table 40 according to Example Embodiment 1.

Furthermore, the position of the ring groove 60 where the through hole 44*a* is open is such that, when the ring groove 60 is located at a farther distance from the corresponding communication hole 47 (the ring groove 60 in which the through hole 44*a* is open that communicates with the same air chamber 45 into which the communication hole 47 is open), the through hole 44*a* open in the ring groove 60 is formed at a position closer to the communication hole 47.

Details will be described below.

Figure 9:
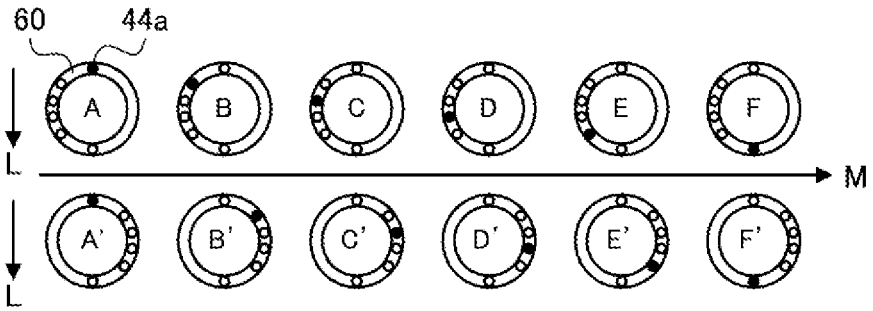
FIG. 9 is an explanatory diagram illustrating examples of types of positions of through holes open in the ring-shaped grooves serving as the concave portions.

FIG. 9 is an explanatory diagram illustrating examples of types of positions of the through holes 44*a* open in the ring grooves 60. A direction of arrows L illustrated in FIG. 9 represents a direction in which the communication holes 47 (the communication holes 47 formed in the air chamber 45 positioned to overlap the ring groove 60) are present with respect to the ring grooves 60 in a plan view. Furthermore, the ring grooves 60 (A to F) and (A' to F') arranged in a direction of arrow M indicate that there are six available types of positions of the through hole 44*a* in the ring groove 60. Here, blank circles illustrated in groove sections of the ring grooves 60 (A to F) and (A' to F') represent candidates of the position of the through hole 44*a*. Filled circles represent the positions where the through holes 44*a* are actually formed with respect to the candidates. In other words, in the ring groove 60 illustrated at a farther distance in the direction of arrow M, the corresponding through hole 44*a* is formed at a position closer to the corresponding communication hole 47 present in the direction of arrows L.

The ring grooves 60 (A to F) have a line symmetric relation with the ring grooves 60 (A' to F'). In a case where the ring grooves 60 are formed at the same position, the distance from the communication hole 47 to the through hole 44*a* is as follows:

Ring groove 60(A)=Ring groove 60(A')
Ring groove 60(B)=Ring groove 60(B')
Ring groove 60(C)=Ring groove 60(C')
Ring groove 60(D)=Ring groove 60(D')
Ring groove 60(E)=Ring groove 60(E')
Ring groove 60(F)=Ring groove 60(F')

Figure 10:
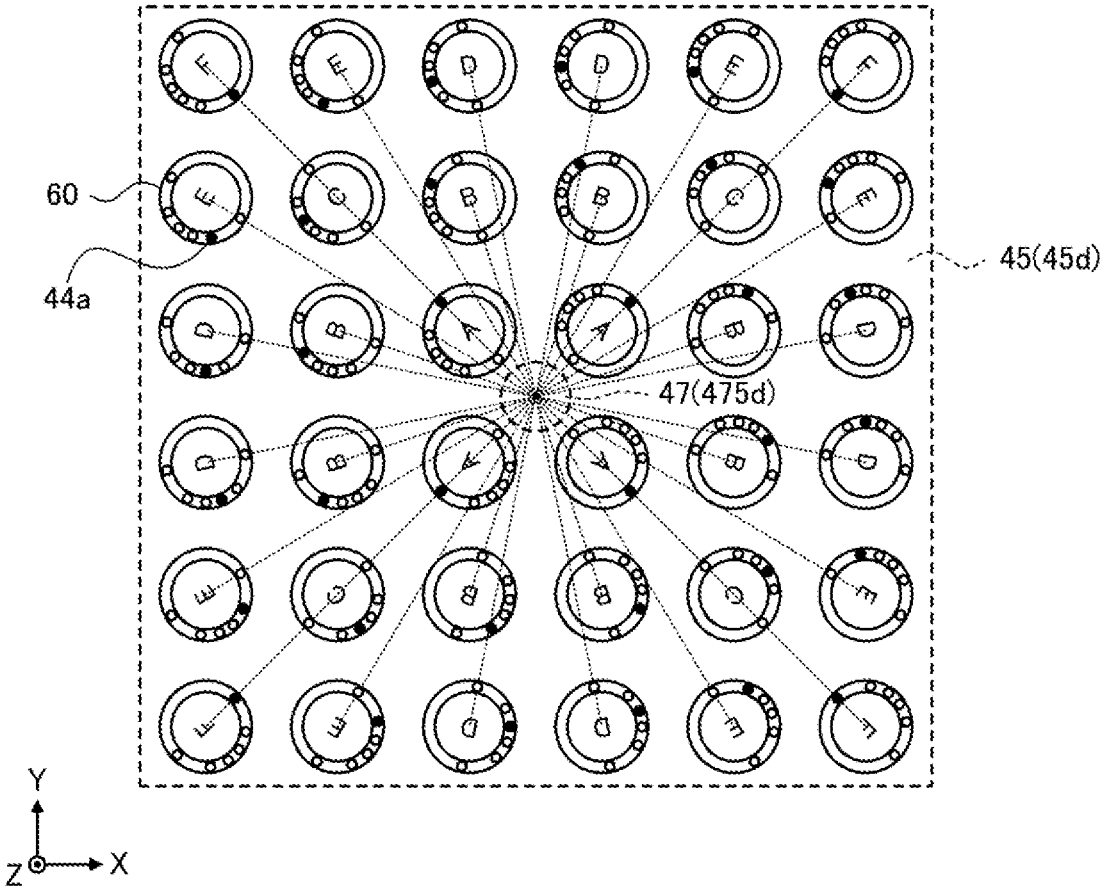
FIG. 10 is a plan view illustrating an example of the ring-shaped groove formed in the platen as the concave portion and the through holes.

FIG. 10 is a plan view illustrating an example of the ring grooves 60 and the through holes 44*a* formed in the platen 41.

The example illustrated in FIG. 10 illustrates that the ring grooves 60 positioned to overlap one air chamber 45 in a plan view are arranged in a 6×6 matrix (e.g., a case of the air chamber 45*d* (see FIG. 4). In this case, this arrangement involves six types of distances from the communication hole 47 (e.g., a communication hole 475*d*) formed in the air chamber 45. The ring grooves 60 (A to F) are arranged according to the distance. Specifically, for the ring groove 60 at a farther distance from the corresponding communication hole 47, the through hole 44*a* in the ring groove 60 is formed closer to the communication hole 47. In other words, when the communication hole 47 is defined as a hole in which each of the communication tubes T1 to T6 are open into the respective air chamber of the plural air chambers 45*a* to 45*k*, each of the plural through holes 44*a* is formed corresponding in each of the ring grooves 60 as the plural concave portions. Furthermore, in a plan view of the loading surface 41S, each of the plural through holes 44*a* is formed at a position close to the communication hole 47 in each of the ring grooves 60 as leaving from the communication hole 47.

Note that, in a case where the arrangement involves more than six types of distances from the communication hole 47 to the ring groove 60, for the ring grooves 60 with similar distances, the ring grooves 60 included in the ring grooves 60 (A to F) and the ring grooves 60 (A' to F') and positioned at the same distance to the communication hole 47 may be used. Alternatively, the types of the position of the through hole 44*a* open in the ring groove 60 as illustrated in FIG. 9 may be increased as appropriate according to the type of the distance from the communication hole 47 to the ring groove 60.

As described above, according to the printing apparatus and the target printing medium holding device according to Example Embodiment 2, the following advantages can be achieved.

The through holes 44*a* are formed to be open in the ring grooves 60 formed in the loading surface 41Sa. Thus, when the target printing medium is loaded onto the loading surface 41Sa, the target printing medium can be sucked and held by a suction force approximately proportional to the area of a portion of the target printing medium overlapping the ring grooves 60. That is, compared to a case of suction with no ring grooves 60 formed, this configuration allows the target printing medium to be more strongly sucked and more stably held on the loading surface 41Sa of the platen 41.

Furthermore, for the ring groove 60 at a farther distance from the corresponding communication hole 47 (the ring groove 60 in which the through hole 44*a* is open that communicates with the air chamber 45 in which the communication hole 47 is open), the through hole 44*a* open in the ring groove 60 is formed closer to the communication hole 47. This enables a reduction in differences in flow path resistance (i.e., pressure loss) resulting from differences in the distance between the communication hole 47 and each of the through holes 44*a*. As a result, the target printing medium can be more stably held on the loading surface 41Sa of the platen 41.

Furthermore, since the ring grooves 60 are each formed of a ring-shaped groove, the target printing medium can be sucked over a range of extension of the grooves. In a case where the loaded target printing medium covers the ring-shaped grooves, the target printing medium can be sucked at a uniform pressure over the range of extension of the grooves. Furthermore, each of the ring-shaped grooves includes no ends, thus, e.g., preventing foreign materials from adhering to and accumulating on the ends of the groove as a result of suction. Even in a case where foreign materials adhere to the groove, wiping along the ring-shaped groove makes the foreign materials unlikely to remain in the groove, facilitating cleaning.

Note that the described ring grooves 60 are approximately perfectly circular grooves as illustrated in the drawings, but the invention is not limited to the perfectly circular shape. For example, the grooves may be shaped like ellipses. Furthermore, in a case where the above-described facilitation of cleaning is not pursued, the grooves are not limited to the ring shape but may be shaped like, e.g., horseshoes or may be curved or linear.

Example Embodiment 3

Now, a printing apparatus and a target printing medium holding device according to Example Embodiment 3 will be described. Note that, the same constituents as those in the example embodiments described above are given the same reference signs, and redundant description of these constituents will be omitted.

In the description of Example Embodiment 1, each of the air chambers 45 provided inside the platen loading stand 42 (on the underside of the platen 41) is configured as a space that is open at the top portion due to the plurality of through holes 44 and at the bottom portion due to the one communication hole 47. In Example Embodiment 3, for each of the air chambers 45 provided inside the platen loading stand 42 (on the underside of the platen 41), a "tube" is provided in a flow path through which air flows between the corresponding communication hole 47 and each of the through holes 44 communicating with the air chamber 45 in which the communication hole 47 is open. Furthermore, the "tube" provided in the flow path with a shorter distance between the communication hole 47 and the through hole 44 has a larger flow path length.

Details will be described below.

Figure 11:
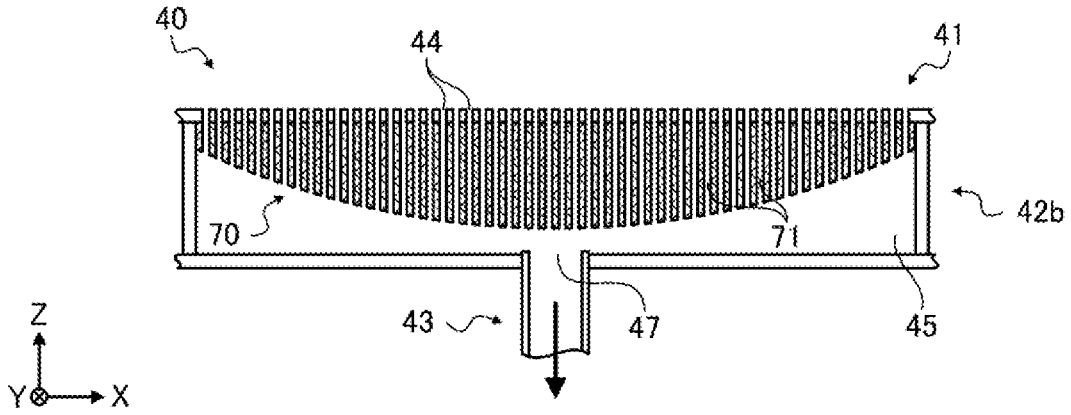
FIG. 11 is a cross-sectional view illustrating a configuration of a platen stand provided in a printing apparatus and in a target printing medium holding device according to Example Embodiment 3.

FIG. 11 is a cross-sectional view illustrating a configuration of a platen loading stand 42*b* provided instead of the platen loading stand 42 in the printing apparatus (printer 1) and the target printing medium holding device (support table 40) according to Example Embodiment 3. FIG. 11 illustrates a range of one of the air chambers 45 in the platen loading stand 42*b*.

Each of the air chambers 45 (air chambers 45*a* to 45*k*) provided in the platen loading stand 42*b* includes a honeycomb structural plate 70 configured to back the platen 41. In other words, the honeycomb structural plate 70 is provided opposite to the loading surface 41S. Except for the above-described components, the printer 1 and the support table 40 according to Example Embodiment 3 are the same as the printer 1 and the support table 40 according to Example Embodiment 1.

The honeycomb structural plate 70 is an assembly of prismatic tubes (hexagonal prismatic tubes) extending in the Z-axial direction. The honeycomb structural plate 70 includes a flat plate attached to a top portion side of the assembled prismatic tubes and a curved plate attached to a bottom portion side of the assembled prismatic tubes. The top-section-side flat plate and the bottom-section-side curved plate are open at positions overlapped by the through holes 44 in a plan view (holes are formed in communication with the through holes 44 and the air chamber 45). The prismatic tubes (located at the opening and being open at the top portion and the bottom portion) allow the through holes 44 to communicate with the air chamber 45.

Each of the prismatic tubes that is open at the top and bottom sections and that allows the corresponding through hole 44 to communicate with the air chamber 45 is configured as a "tube" in the flow path between the communication hole 47 and the corresponding through hole 44. When the air blower B1 is used to suck and exhaust the air in each of the air chambers 45*a* to 45*k*, each of the "tubes" cause a prescribed pressure loss in the corresponding flow path through which air flows between the communication hole 47 and the corresponding through hole 44 communicating with the air chamber 45 in which the communication hole 47 is open.

The prismatic tube (the prismatic tube being open at the top and bottom sections) serving as the "tube" allowing the corresponding through hole 44 to communicate with the air chamber 45 is hereinafter referred to a pressure loss tube 71.

In the honeycomb structural plate 70, the top-section-side flat plate is attached to a lower surface of the platen 41, as illustrated in FIG. 11. Furthermore, the bottom-section-side curved plate is shaped to be downward convex and configured such that, in the air chamber 45, a thickness of the honeycomb structural plate 70 decreases with increasing distance from the communication hole 47. In other words, as illustrated in FIG. 11, each of the pressure loss tubes 71 is configured such that a flow path length of each pressure loss tube 71 decreases with increasing distance from the communication hole 47 (the flow path length increases with decreasing distance from the communication hole 47).

That is, the pressure loss tubes 71 (each causing a prescribed pressure loss) is provided in the corresponding flow path through which air flows between the communication hole 47 and the corresponding through hole 44 communicating with the air chamber 45 in which the communication hole 47 is open. The pressure loss tube 71 that is provided in the flow path with a shorter distance (or with a closer distance) between the communication hole 47 and the through hole 44 has a longer flow path distance and causes the prescribed pressure loss to be larger. In other words, the pressure loss tubes 71 are configured as follows. The length of each pressure loss tube 71 increases with decreasing distance (pressure loss) between a bottom portion (an opening into the air chamber 45) of the pressure loss tube 71 and the communication hole 47 and thus with decreasing flow path resistance between the bottom portion and the communication hole 47. In contrast, the length of each pressure loss tube 71 decreases with increasing distance between the bottom portion (the opening into the air chamber 45) of the pressure loss tube 71 and the communication hole 47 and thus with increasing flow path resistance (pressure loss) between the bottom portion and the communication hole 47.

As described above, according to the printing apparatus and the target printing medium holding device according to Example Embodiment 3, the following advantages can be achieved.

The pressure loss tube 71 provided in the flow path with a shorter distance between the communication hole 47 and the through hole 44 (the through hole 44 communicating with the air chamber 45 in which the communication hole 47 is open) has a longer flow path distance. This enables a reduction in differences in flow path resistance (pressure loss) among the flow paths between the communication hole 47 and the respective through holes 44. As a result, differences in suction force sucking the target printing medium (differences in an in-plane distribution of the suction force in the target printing medium) can be reduced, allowing the target printing medium to be more stably held on the loading surface 41S of the platen 41.

Furthermore, backing the platen 41 with the honeycomb structural plate 70 allows rigidity of the platen 41 to be enhanced. The prismatic tubes positioned to overlap the through holes 44 and included in the prismatic tubes forming the honeycomb structural plate 70 are each open at the top portion and the bottom portion of the tube. Each of the prismatic tubes may thus be configured as the pressure loss tube 71 in the corresponding flow path between the communication hole 47 and the corresponding through hole 44. Moreover, a change in the thickness of the honeycomb structural plate 70 enables a change in the flow path length of each of the pressure loss tubes 71 configured as described above. That is, the platen 41 is backed with the honeycomb structural plate 70 to enhance the rigidity of the platen 41, while each of the pressure loss tubes 71 is configured to have a flow path distance increasing with decreasing distance between the communication hole 47 and the corresponding through hole 44 in the flow path where the pressure loss tube is provided (the thickness of the honeycomb structural plate 70 increases with decreasing distance). This enables a reduction in differences in flow path resistance (pressure loss) among the flow paths between the communication hole 47 and the respective through holes 44. As a result, the target printing medium can be more stably held on the loading surface 41S of the platen 41.

Example Embodiment 4

Now, a printing apparatus and a target printing medium holding device according to Example Embodiment 4 will be described. Note that, the same constituents as those in the example embodiments described above are given the same reference signs, and redundant description of these constituents will be omitted.

Figure 12:
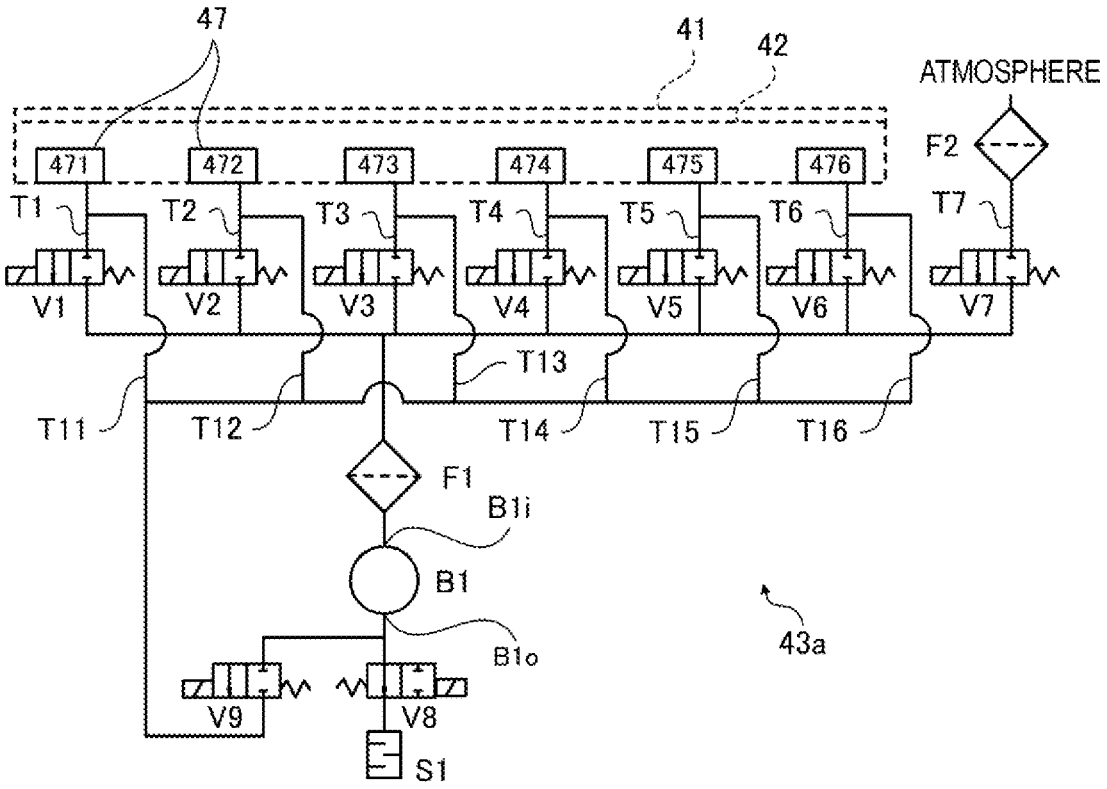
FIG. 12 is a pneumatic circuit diagram illustrating a configuration of a suction mechanism provided in a printing apparatus and in a target printing medium holding device according to Example Embodiment 4.

FIG. 12 is a pneumatic circuit diagram illustrating a configuration of a suction mechanism 43*a* provided in the printing apparatus (printer 1) and in the target printing medium holding device (support table 40) instead of the suction mechanism 43, according to Example Embodiment 4.

In addition to the components of the suction mechanism 43 according to Example Embodiment 1, the suction mechanism 43*a* according to Example Embodiment 4 includes, for example, a suction tube T7, a filter F2, an open opening/closing valve V7, air blow tubes T11 to T16, and air blow opening/closing valves V8 and V9.

The suction tube T7 is a piping including a first end communicating with the filter F2 and a second end communicating with the filter F1 communicating with the suction port B1*i* of the air blower B1. The suction tube T7 forms a flow path allowing the suction port B1*i* of the air blower B1 to communicate with the atmosphere.

The filter F2 is an air filter configured to trap foreign materials contained in the atmosphere and is connected to an air suction portion of the suction tube T7.

The open opening/closing valve V7 is a two-port solenoid valve provided in the suction tube T7 and is capable of opening and closing communication between the atmosphere and the suction port B1*i*.

The air blow tubes T11 to T16 are piping including first ends individually communicating with the respective communication holes 47 (communication holes 471 to 476) in the 11 air chambers 45*a* to 45*k*, and second ends collectively communicating with an exhaust port B1*o* of the air blower B1.

The air blow opening/closing valve V8 is a two-port solenoid valve capable of opening and closing communication between the exhaust port B1*o* of the air blower B1 and the silencer S1 (in other words, opening the exhaust port B1*o* air into the atmosphere).

The air blow opening/closing valve V9 is a two-port solenoid valve capable of opening and closing communication between the exhaust port B1*o* of the air blower B1 and each of the air chambers 45 via a corresponding one of the air blow tubes T11 to T16. The second ends of the air blow tubes T11 to T16 are assembled into piping communicating with the exhaust port B1*o* of the air blower B1.

In the above-described configuration of the suction mechanism 43*a*, control of the suction mechanism 43*a* is switched, under the control of the control unit 50, between a mode in which the target printing medium is sucked onto the loading surface 41S of the platen 41 and a mode in which the sucked and held target printing medium is removed from the loading surface 41S.

Figure 13:
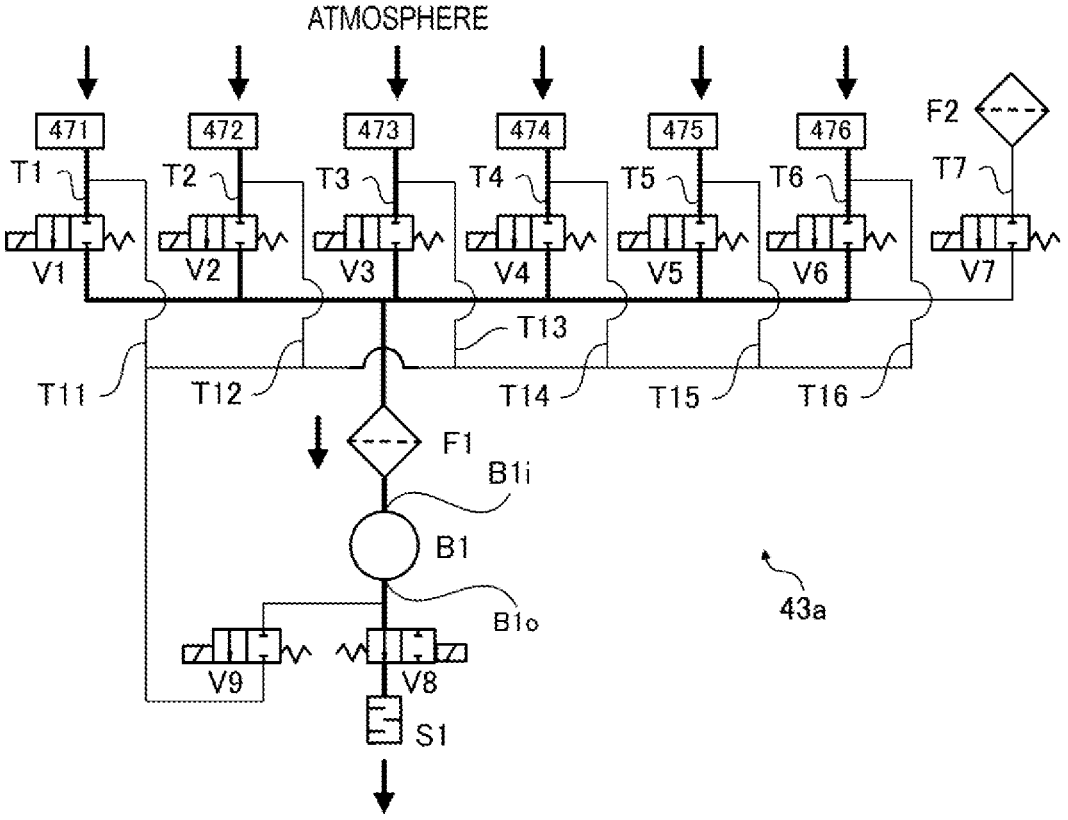
FIG. 13 is a pneumatic circuit diagram illustrating a flow of air based on control performed when a target printing medium is sucked onto a loading surface of the platen.

FIG. 13 is a pneumatic circuit diagram illustrating a flow of air based on the control performed when the target printing medium is sucked onto the loading surface 41S of the platen 41.

The open opening/closing valve V7 and the air blow opening/closing valve V9 are closed and the air blow opening/closing valve V8 is opened to allow configuration of a pneumatic circuit fulfilling the same functions as the functions illustrated in the pneumatic circuit diagram of Example Embodiment 1 in FIG. 5. That is, in this state, the air blower B1 controllably sucks air, while the control unit 50 performs opening/closing control on the suction opening/closing valves V1 to V6. This enables air to be selectively sucked through the through holes 44 communicating with the corresponding air chambers 45*a* to 45*k* divided into the six groups, allowing control of target printing media with various sizes to be effectively and efficiently sucked on the loading surface 41S.

Figure 14:
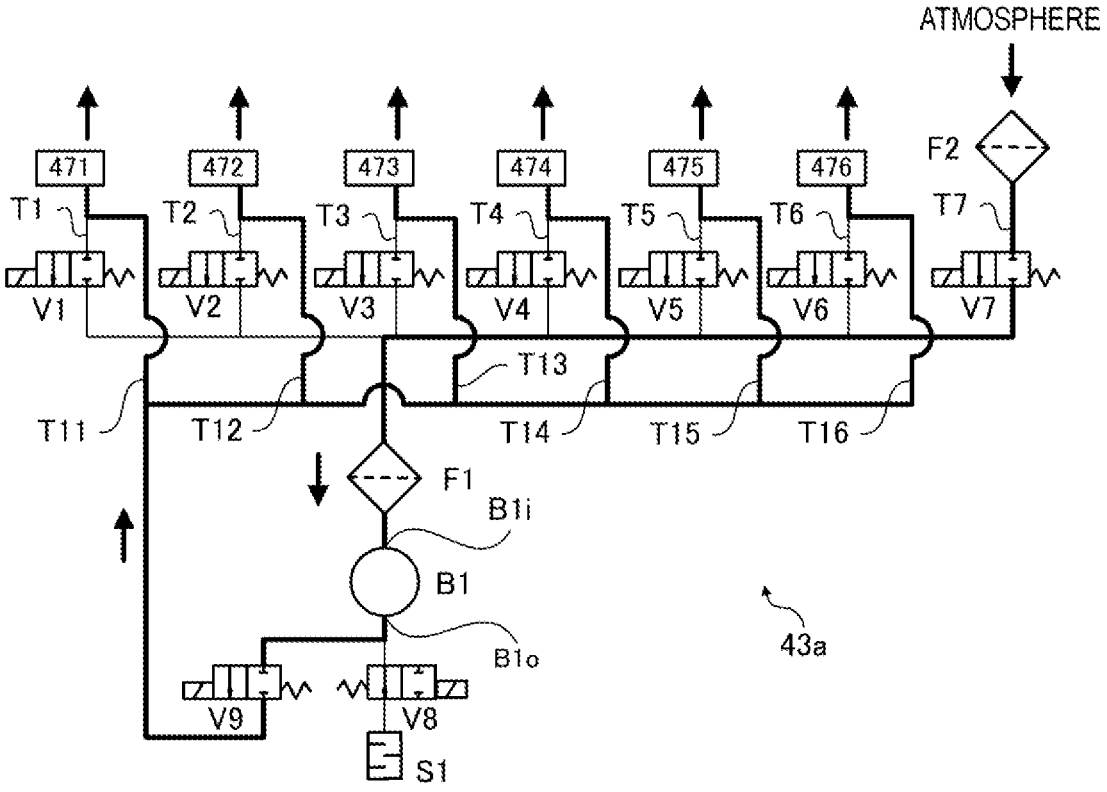
FIG. 14 is a pneumatic circuit diagram illustrating a flow of air based on control performed when the target printing medium held on the loading surface is removed.

FIG. 14 is a pneumatic circuit diagram illustrating a flow of air based on the control performed when the target printing medium held on the loading surface 41S is removed from the loading surface 41S.

The suction opening/closing valves V1 to V6 are closed and the open opening/closing valve V7 is opened to allow the suction port B1*i* of the air blower B1 to communicate with the atmosphere. The air blow opening/closing valve V8 is closed and the air blow opening/closing valve V9 are opened to connect each of the air chambers 45 to the exhaust port B1*o* of the air blower B1. The air blower B1 is operated to allow the atmosphere sucked and exhausted by the air blower B1 to be sucked into the air chambers 45 and sprayed through the through holes 44 formed in the loading surface 41S of the platen 41.

As described above, the printing apparatus and the target printing medium holding device according to Example Embodiment 4 include the suction mechanism 43*a*. Thus, in addition to producing the effects of Example Embodiment 1, Example Embodiment 4 allows the target printing medium loaded and sucked onto the loading surface 41S of the platen 41 to be more easily removed and more easily moved.

Note that the invention is not limited to the above-described example embodiments, and various modifications and improvements can be made to the above-described example embodiments. A modification of Example Embodiment 4 will be described below.

Modification

Figure 15:
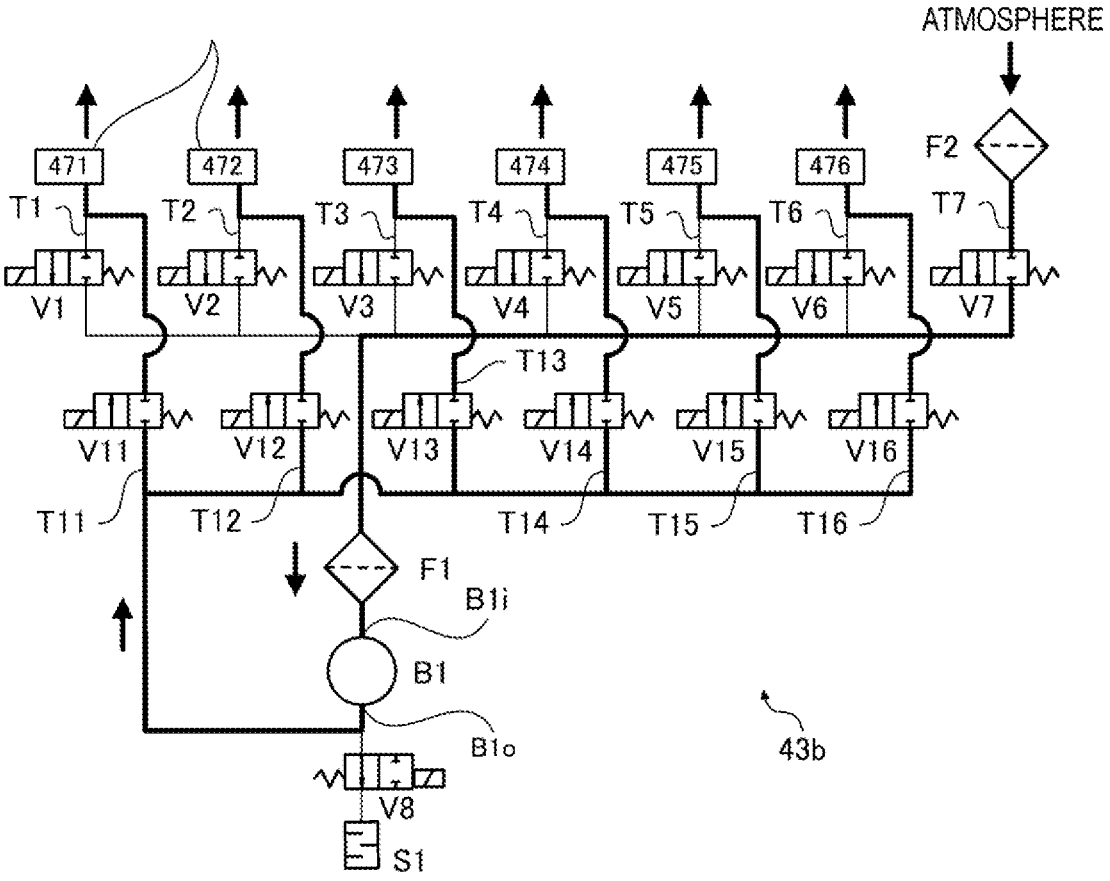
FIG. 15 is a pneumatic circuit diagram illustrating a configuration of a modification of a suction mechanism according to Example Embodiment 4.

FIG. 15 is a pneumatic circuit diagram illustrating a configuration of a suction mechanism 43*b* as a modification of the suction mechanism 43*a* according to Example Embodiment 4.

The suction mechanism 43*b* includes air blow opening/closing valves V11 to V16 instead of the air blow opening/closing valve V9 (see FIG. 14) provided in the suction mechanism 43*a*.

In Example Embodiment 4, the second ends of the air blow tubes T11 to T16 are assembled into the piping communicating with the exhaust port B1*o* of the air blower B1, and the air blow opening/closing valve V9 is capable of collectively opening and closing communication between the exhaust port B1*o* of the air blower B1 and the air chambers 45 via the respective air blow tubes T11 to T16. In contrast, as illustrated in FIG. 15, the air blow opening/closing valves V11 to V16 are individually provided in piping on the first end sides of the air blow tubes T11 to T16 (the piping individually communicating with the respective communication holes 471 to 476). The air blow opening/closing valves V11 to V16 are each capable of independently opening and closing communication between the exhaust port B1*o* of the air blower B1 and a corresponding one of the air chambers 45 via a corresponding one of the air blow tubes T11 to T16.

According to the modification, air can be sucked only through the air chambers 45 positioned to be covered with the target printing medium and can be sprayed through the corresponding through holes 44. This enables air to be more efficiently (more powerfully) sprayed to allow the target printing medium to be more easily removed.

Note that, in Example Embodiments 1 to 4 and the modification, opening/closing control is performed, under the control of the control unit 50, on the solenoid valves such as the suction opening/closing valves V1 to V6, the open opening/closing valve V7, and the air blow opening/closing valves V8, V9, and V11 to V16. However, each of the valves may be configured by a valve that can be manually opened and closed, and the opening/closing may be manually controlled.

Contents derived from the example embodiments are described below.

A printing apparatus includes a platen including a loading surface on which a target printing medium is loaded and in which a plurality of through holes are formed, a printing unit configured to perform printing on the target printing medium loaded on the loading surface, a platen stand on which the platen is loaded, the platen stand including a plurality of air chambers communicating with the plurality of through holes, a plurality of communication tubes configured to individually communicate with the plurality of air chambers, an air blower configured to suck and exhaust air in the plurality of air chambers with which the air blower communicates via the plurality of communication tubes, and a plurality of suction opening/closing valves individually provided in the plurality of communication tubes, the plurality of suction opening/closing valves configured to open and close communication between the air blower and the plurality of air chambers, wherein the plurality of air chambers are provided at different positions adjacent to one another in a length direction and a width direction of the target printing medium loaded on the loading surface.

According to this configuration, the air blower sucks the air in the air chambers to suck the target printing medium loaded on the loading surface of the platen, via the through holes formed in the loading surface and in communication with the air chambers, allowing the target printing medium to be held (sucked) on the loading surface of the platen. Furthermore, the plurality of air chambers are provided that communicate with the through holes formed in the loading surface of the platen, and the plurality of suction opening/ closing valves are provided each of which is capable of opening and closing the communication between a corresponding one of the air chambers and the air blower sucking and exhausting the air in the air chamber. Thus, the suction opening/closing valves are opened or closed to allow selection of the through holes via which the target printing medium is sucked and held on the loading surface of the platen (selection of an area where the through holes are arranged). For example, the through holes positioned to be covered with the target printing medium (the area where the through hole are arranged) are selected in accordance with the size of the target printing medium. This allows the target printing medium to be more effectively and efficiently sucked and held.

Furthermore, the air chambers are provided at different positions in the length direction and the width direction of the target printing medium. Thus, the suction opening/closing valves are opened or closed to allow the through holes via which the target printing medium is sucked and held (the area where the through holes are arranged) to be selected in the length direction and the width direction of the target printing medium. That is, the air chambers are arranged to allow selection of the through holes positioned to be covered with the target printing medium, in accordance with target printing media with different sizes in the length direction and/or the width direction. This allows the target printing medium to be more effectively and efficiently sucked and held according to the size of the target printing medium.

As a result, the printing unit is capable of more stably printing the target printing medium loaded on the loading surface of the platen.

Furthermore, it may be sufficient to provide a single air blower for the plurality of air chambers provided to allow selection, according to the size of the target printing medium, of the through holes positioned to be covered with the target printing medium. Compared to a case where the air blower is independently provided for each of the plurality of air chambers, this configuration enables prevention of an increase in costs.

Preferably, in the printing apparatus, the plurality of through holes are open in concave portions formed in the loading surface.

According to this configuration, the through holes are formed to be open in the concave portions formed in the loading surface. Thus, when the target printing medium is loaded onto the loading surface, the target printing medium can be sucked and held by a suction force approximately proportional to the area of a portion of the target printing medium overlapping the concave portions. That is, compared to a case of suction with no concave portions formed, this configuration allows the target printing medium to be more strongly sucked and more stably held on the loading surface of the platen.

Preferably, in the printing apparatus, for each of the concave portions provided with the plurality of through holes communicating with the plurality of air chambers including the plurality of communication holes being open, as the concave portion is located at a farther distance from a communication hole through which a corresponding one of the plurality of communication tubes is open into a corresponding one of the plurality of air chambers, the through hole being open in the concave portion is formed at a position closer to the communication hole in the concave portion.

According to this configuration, for each of the concave portions when the concave portion is located at a farther distance from the communication hole (the communication hole via which the air in the corresponding air chamber is sucked) (the concave portion is one of the concave portions in which a corresponding one of the through holes communicating with the corresponding air chamber is open, the communication hole being open in the corresponding air chamber), the corresponding through hole open in the concave portion is formed at a position closer to the communication hole. This enables a reduction in differences in flow path resistance (i.e., pressure loss) resulting from differences in the distance between the communication hole (the communication hole via which the air in the corresponding air chamber is sucked) and the through hole (the through hole communicating with the corresponding air chamber formed in the loading surface of the platen). As a result, the target printing medium can be more stably held on the loading surface of the platen.

Preferably, in the printing apparatus, the concave portions are ring-shaped grooves.

According to this configuration, since the concave portions are each formed of a ring-shaped groove, the target printing medium can be sucked over a range of extension of the grooves. In a case where the loaded target printing medium covers the ring-shaped grooves, the target printing medium can be sucked at a uniform pressure over the range of extension of the grooves. Furthermore, each of the ring-shaped grooves includes no ends, thus, e.g., preventing foreign materials from adhering to and accumulating on the ends of the groove as a result of suction. Even in a case where foreign materials adhere to the groove, wiping along the ring-shaped groove makes the foreign materials unlikely to remain in the groove, facilitating cleaning.

Preferably, in the printing apparatus, a tube is provided in a flow path through which air flows between the communication hole through which a corresponding one of the plurality of communication tubes is open into a corresponding one of the plurality of air chambers and each of a plurality of the through holes communicating with the corresponding one of the plurality of air chambers in which the communication hole is open, and the tube provided in the flow path with a shorter distance between the communication hole and the through hole has a larger flow path length.

According to this configuration, the tube provided in the flow path with a shorter distance between the communication hole (the communication hole through which the communication tube is open into the corresponding air chamber) and the through hole (the through hole communicating with the air chamber in which the communication hole is open) has a longer flow path distance. This enables a reduction in differences in flow path resistance (pressure loss) among the flow paths between the communication hole and the respective through holes. As a result, the target printing medium can be more stably held on the loading surface of the platen.

Preferably, in the printing apparatus, a honeycomb structural plate configured to back the platen, wherein each of the tubes is formed of a prismatic tube included in the honeycomb structural plate.

According to this configuration, backing the platen with the honeycomb structural plate allows rigidity of the platen to be enhanced. Furthermore, the prismatic tubes positioned to overlap the through holes and included in the prismatic tubes forming the honeycomb structural plate are each open at the top portion and the bottom portion of the tube. Each of the prismatic tubes may thus be configured as the tube in the corresponding flow path between the communication hole and the corresponding through hole. Moreover, a change in the thickness of the honeycomb structural plate enables a change in the flow path length of each of the tubes configured as described above. That is, the platen is backed with the honeycomb structural plate to enhance the rigidity of the platen, while each of the tubes is configured to have a flow path distance increasing with decreasing distance between the communication hole and the corresponding through hole in the flow path where the pressure loss tube is provided (the thickness of the honeycomb structural plate increases with decreasing distance). This enables a reduction in differences in flow path resistance (pressure loss) among the flow paths between the communication hole and the respective through holes. As a result, the target printing medium can be more stably held on the loading surface of the platen.

Preferably, in the printing apparatus, a suction tube configured to cause a suction port of the air blower sucking air to communicate with atmosphere, an open opening/closing valve provided in the suction tube and configured to open and close communication between the atmosphere and the suction port, an air blow tube configured to communicate with the plurality of air chambers and to allow each of the plurality of air chambers to communicate with the exhaust port of the air blower through which air sucked by the air blower is exhausted, and an air blow opening/closing valve configured to open and close communication between the exhaust port and each of the plurality of air chambers via the air blow tube.

According to this configuration, the suction opening/closing valves are closed to allow the suction port of the air blower to communicate with the atmosphere. The air blow opening/closing valve is opened to connect each of the air chambers to the exhaust port of the air blower. This enables air exhausted by the air blower to be sucked into the air chambers and sprayed through the through holes formed in the loading surface of the platen. This allows the target printing medium loaded and sucked onto the loading surface of the platen to be more easily removed and more easily moved.

A target printing medium holding device in the application includes a platen including a loading surface on which a target printing medium is loaded and in which a plurality of through holes are formed, a platen stand on which the platen is loaded, the platen stand including a plurality of air chambers communicating with the plurality of through holes, a plurality of communication tubes configured to individually communicate with the plurality of air chambers, an air blower configured to suck and exhaust air in the plurality of air chambers with which the air blower communicates via the plurality of communication tubes, and a plurality of suction opening/closing valves individually provided in the plurality of communication tubes, the plurality of suction opening/closing valves configured to open and close communication between the air blower and the plurality of air chambers, wherein the plurality of air chambers are provided at different positions adjacent to one another in a length direction and a width direction of the target printing medium loaded on the loading surface.

According to this configuration, the air blower sucks the air in the air chambers to suck the target printing medium loaded on the loading surface of the platen, via the through holes formed in the loading surface and in communication with the air chambers, allowing the target printing medium to be held (sucked) on the loading surface of the platen. Furthermore, the plurality of air chambers are provided that communicate with the through holes formed in the loading surface of the platen, and the plurality of suction opening/closing valves are provided each of which is capable of opening and closing the communication between a corresponding one of the air chambers and the air blower sucking and exhausting the air in the air chamber. Thus, the suction opening/closing valves are opened or closed to allow selection of the through holes via which the target printing medium is sucked and held on the loading surface of the platen (selection of an area where the through holes are arranged). For example, the through holes positioned to be covered with the target printing medium (the area where the through hole are arranged) are selected in accordance with the size of the target printing medium. This allows the target printing medium to be more effectively and efficiently sucked and held.

Furthermore, the air chambers are provided at different positions in the length direction and the width direction of the target printing medium. Thus, the suction opening/closing valves are opened or closed to allow the through holes via which the target printing medium is sucked and held (the area where the through holes are arranged) to be selected in the length direction and the width direction of the target printing medium. That is, the air chambers are arranged to allow selection of the through holes positioned to be covered with the target printing medium, in accordance with target printing media with different sizes in the length direction and/or the width direction. This allows the target printing medium to be more effectively and efficiently sucked and held according to the size of the target printing medium.

What is claimed is:

1. A printing apparatus comprising:

a platen including a loading surface in which plural through holes are formed and which are configured to hold by suction force a target printing medium loaded onto the loading surface;

a printing unit configured to perform printing on the target printing medium loaded on the loading surface;

a platen stand on which the platen is loaded, the platen stand including plural air chambers communicating with the plural through holes;

plural communication tubes, each individually communicating with a respective air chamber of the plural air chambers;

an air blower configured to suck and exhaust air from the plural air chambers with which the air blower communicates via the plural communication tubes; and plural suction opening/closing valves, each individually provided in a corresponding communication tube of the plurality of communication tubes, the plural suction opening/closing valves each being configured to open and close communication between the air blower and the respective air chamber of the plurality of air chambers, wherein the plural air chambers are provided adjacent to one another at different positions in a length direction and a width direction of the target printing medium loaded on the loading surface.

2. The printing apparatus according to claim 1, wherein the plural through holes are open to each of plural concave portions formed on the loading surface.

3. The printing apparatus according to claim 2, wherein when a communication hole is defined as a hole in which each of the communication tubes are open into the respective air chamber of the plural air chambers, each of the plural through holes is formed corresponding in each of the plural concave portions, and in a plan view of the loading surface, each of the plural through holes is formed at a position close to the communication hole in each of the plural concave portions as leaving from the communication hole.

4. The printing apparatus according to claim 2, wherein the concave portions are ring-shaped grooves.

5. The printing apparatus according to claim 1, wherein when a communication hole is defined as a hole in which each of the communication tubes are open into the respective air chamber of the plural air chambers, a tube is provided in each of flow paths through which air flows, the tube is provided between the communication hole and respective through hole of the plural through holes communicating with the plural air chambers, and one of the tubes provided in the flow paths with a closer distance between a corresponding one of the communication holes and a corresponding one of the plural through holes has a larger flow path length.

6. The printing apparatus according to claim 5, comprising:

a honeycomb structural plate provided opposite to the loading surface, wherein the tube is formed of a prismatic tube included in the honeycomb structural plate.

7. The printing apparatus according to claim 1, comprising:

a suction tube configured to cause a suction port of the air blower sucking air to communicate with atmosphere;

an open opening/closing valve provided in the suction tube and configured to open and close communication between the atmosphere and the suction port;

an air blow tube configured to communicate with the plurality of air chambers and to allow the plural air chambers to communicate with an exhaust port of the air blower through which air sucked by the air blower is exhausted; and an air blow opening/closing valve configured to open and close communication between the exhaust port and the plural air chambers via the air blow tube.

8. A target printing medium holding device comprising:

a platen including a loading surface in which a plurality of through holes are formed and which are configured to hold by suction force a target printing medium loaded onto the loading surface;

a platen stand on which the platen is loaded, the platen stand including a plural air chambers communicating with the plurality of through holes;

plural communication tubes, each individually communicating with a respective air chamber of the plurality of air chambers;

an air blower configured to suck and exhaust air from the plurality of air chambers with which the air blower communicates via the plurality of communication tubes; and a plurality of suction opening/closing valves, each individually provided in a corresponding communication tube of the plurality of communication tubes, the plurality of suction opening/closing valves each being configured to open and close communication between the air blower and the respective plurality of air chambers, wherein the plurality of air chambers are provided adjacent to one another at different positions in a length direction and a width direction of the target printing medium loaded on the loading surface.

* * * * *